US007533715B1

(12) United States Patent
Klahn et al.

(10) Patent No.: US 7,533,715 B1
(45) Date of Patent: May 19, 2009

(54) TUBE WALKER FOR EXAMINATION AND REPAIR OF STEAM GENERATORS

(75) Inventors: Kurt David Klahn, Forest, VA (US); George Vick Owen, Forest, VA (US)

(73) Assignee: Areva NP Inc., Lytnchburg, VA (US)

( * ) Notice: Subject to any disclaimer, the term of this patent is extended or adjusted under 35 U.S.C. 154(b) by 1433 days.

(21) Appl. No.: 10/674,121

(22) Filed: Sep. 26, 2003

(51) Int. Cl.
*F22B 37/00* (2006.01)

(52) U.S. Cl. ..... 165/11.2; 165/11.1

(58) Field of Classification Search ..... 165/76, 165/11.1, 11.2; 180/9.21; 414/7; 901/15, 901/21

See application file for complete search history.

(56) References Cited

U.S. PATENT DOCUMENTS 3,966,293 A * 6/1976 Mathe et al. ..... 439/404
4,205,939 A * 6/1980 Reyes ..... 165/11.2
4,205,940 A * 6/1980 Golick ..... 165/11.2
4,213,732 A * 7/1980 Cooper, Jr. ..... 165/76
4,216,893 A * 8/1980 Glatthorn ..... 165/76
4,302,146 A * 11/1981 Finlayson et al. ..... 165/76
4,438,805 A * 3/1984 Gugel ..... 165/11.2
4,507,044 A * 3/1985 Hutchins et al. ..... 901/21
4,673,027 A * 6/1987 Vermaat ..... 165/11.2
4,804,038 A * 2/1989 Klahn et al. ..... 165/11.2
4,924,933 A * 5/1990 Richter et al. ..... 165/76
4,984,627 A * 1/1991 LeBourgeois ..... 165/11.2
5,265,667 A * 11/1993 Lester et al. ..... 165/11.2
5,286,154 A * 2/1994 Jens et al. ..... 414/7
5,355,063 A * 10/1994 Boone et al. ..... 165/11.2
5,757,419 A * 5/1998 Qureshi et al. ..... 348/82
5,956,077 A * 9/1999 Qureshi et al. ..... 901/15
6,814,169 B2 * 11/2004 Moore et al. ..... 180/9.21
7,314,343 B2 * 1/2008 Hawkins et al. ..... 165/11.2

* cited by examiner

*Primary Examiner*—Ljiljana (Lil) V Ciric
(74) *Attorney, Agent, or Firm*—Vytas R. Matas

(57) ABSTRACT

An improved manipulator system having a remotely actuated tube walker assembly for reciprocally moving the manipulator along a tube bundle for inspection and repair of the tubes of the tube bundle wherein the tube walker has a movable inner section and an outboard section with both sections having groups of hydraulically actuated locking fingers which are selectively engageable with the tubes of the tube bundle so that when the fingers of the outboard section are locked the fingers of the inner section are disengaged and the inner portion can be moved axially to an aligned position with new tube locations.

10 Claims, 6 Drawing Sheets

CARRIAGE MOVED LEFT

CARRIAGE MOVED RIGHT

TUBE WALKER FOR EXAMINATION AND REPAIR OF STEAM GENERATORS

BACKGROUND OF THE INVENTION

1. Field of the Invention

The present application is generally drawn to nuclear steam generator examination and repair equipment.

2. Description of the Prior Art

Much of the maintenance performed in nuclear power plants is similar to that of conventional non-nuclear systems. However, nuclear systems are unique in that many components are inaccessible, due to the radiation levels.

In the early years of nuclear power, much of the maintenance was performed manually by workers entering the steam generator head. As maintenance activities and radiation levels increased, it became increasingly difficult to perform steam generator repairs manually. Because inspecting the large number of steam generator tubes is mandatory during refueling outages, this work was a logical candidate for applications of early remote technology. The first manipulator used on Once through Steam Generators (OTSG's) was positioned manually on the tubesheet, locked in place, then computer controlled from a remote location. The manipulator was then moved manually to the next location. For Recirculating Steam Generators (RSG's), an articulated arm manipulator was used having an arm for holding video and or cleaning equipment which was vertically movable into the tube bundle. Although also manually installed, it was not computer controlled. Both manipulators performed well for inspection, but they could not support the heavy tools required for plugging and other tube repair operations. For this reason and also for reduced radiation dose limits, the practice of manually installing the manipulators had to be eliminated.

Development of an advanced manipulator was based on the following criteria:

1. must be installed with no human entry in the steam generator,
2. must perform inspection and repair duties,
3. must access all tubes, and
4. must be computer controlled.

One of the remote manipulator designs is shown in FIG. 1. Named ROGER® (Remotely Operated Generator Examination and Repair); it is covered by U.S. Pat. No. 4,804,038 and was placed in service in the mid nineteen eighties. The unit is installed in the steam generator head by a series of cables and pulleys as shown in FIG. 2. Although light weight in construction, it has a load capacity of 200 lb (91 kg). Once calibrated, the toolhead can be remotely moved to any tube location within the region it was installed with the exception of the mounting location, or "exclusion zone". With the exception of tool head installations, all operations are remotely controlled and monitored by video equipment. The control station is located outside of the containment building and control signals are often multiplexed to reduce the number of cables that must be routed to the building.

One problem was that the manipulator had to be manually moved to different regions within the steam generator. This allows access to the tubes that were in the exclusion zones. Personnel expended time and dose exposure to relocate the manipulator to the desired region. This was especially a problem when personnel were not very experienced.

SUMMARY OF THE INVENTION

The present invention solves these problems of the prior art manipulators and others by providing a system to remotely relocate the above described manipulator with minimal support from personnel on the work platform during reactor shut down. This takes away the need for highly experienced support for manually moving the manipulator. The tube walker of the present invention consists of a movable system for reciprocally moving a body connected to the manipulator having a movable inner section and an outboard section. Both the inner and outboard sections have groups of 4 hydraulically actuated locking fingers which engage the tubes of the steam generator tube bundle. When the 4 fingers of the outboard section are locked in place, the fingers of the inner section are disengaged and the inner portion can be moved axially to an aligned position with new tube locations. Then the inner portion can be locked in place to tubes of the new location and the 4 outboard fingers can be disengaged. This allows the outboard section to be moved to a new tube location. This combination of reciprocal motion allows the walker to traverse in a straight line from one side of the generator tube bundle to the other side and back. The manipulator is attached to the walker using a pneumatic coupler.

From the foregoing it will be seen that there are two advantages with this system. The first is decreased time required to move the manipulator. The manipulator can efficiently and consistently be moved in a time comparable to that of the best moves done remotely by an individual. This system also eliminates any variation in that moving time. The second advantage is less radiation dose received by the support personnel. The need for an individual to be standing at the manway to move the manipulator no longer exists. This results in significant dose savings over the duration of an outage.

In view of the above it will be seen that one aspect of the present invention is to provide a system for easily moving the manipulator across the row of steam generator tubes from a remote location.

Another aspect is to provide a speedy movement of the manipulator to minimize radiation exposure of the personnel during reactor down time.

These and other aspects of the present invention will be more fully understood after a perusal of the following description of the preferred embodiment, when considered along with the accompanying drawings.

DESCRIPTION OF THE PREFERRED EMBODIMENT

Figure 1:
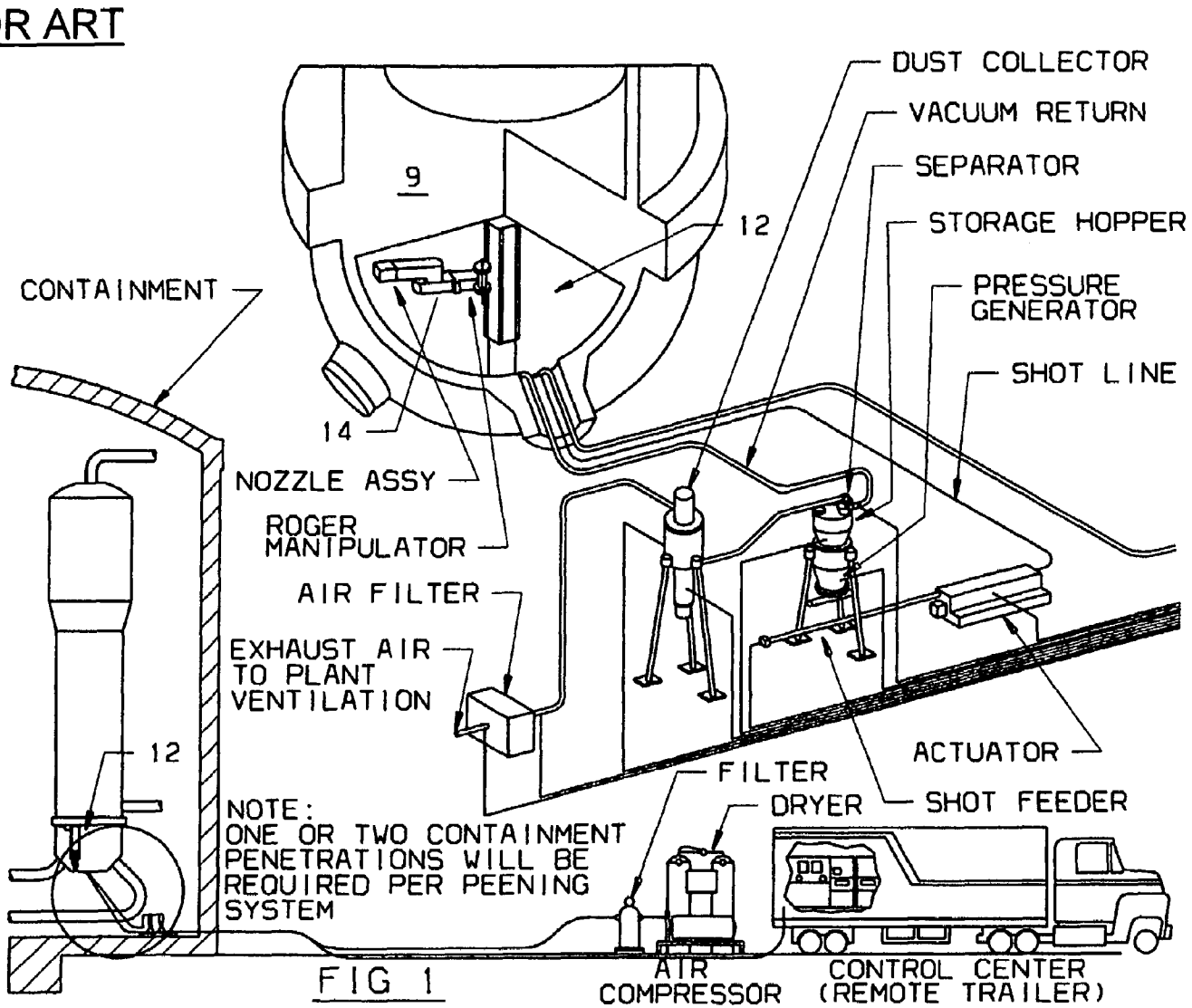
FIG 1 PRIOR ART
FIG. 1 is a schematic view of the prior art steam generator inspection and repair system ®(ROGER)
Figure 2:
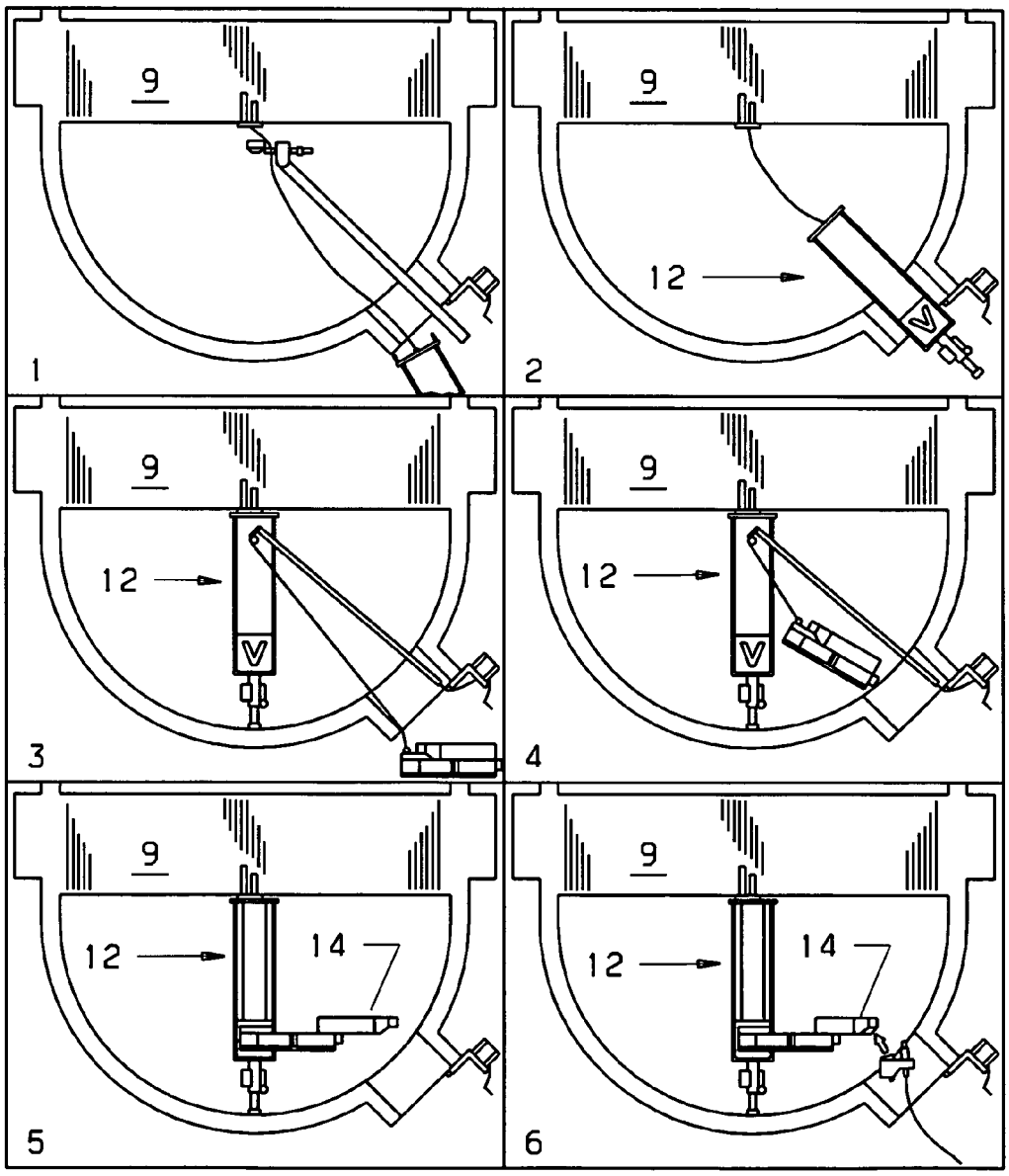
FIG. 2 is a schematic showing the installation of the manipulator of FIG. 1 into the steam generator.
Figure 4:
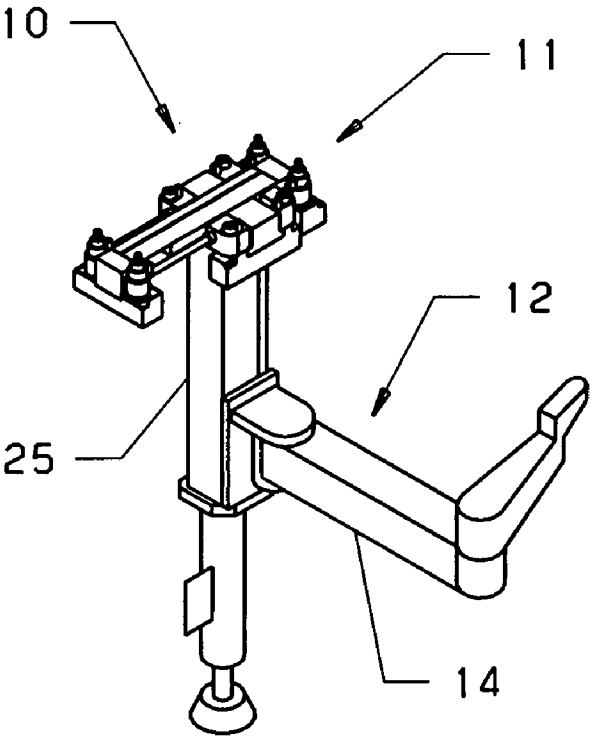
FIG. 4 is a perspective view of the tube walker of FIG. 3 mounted on the manipulator of FIG. 2.
Figure 3:
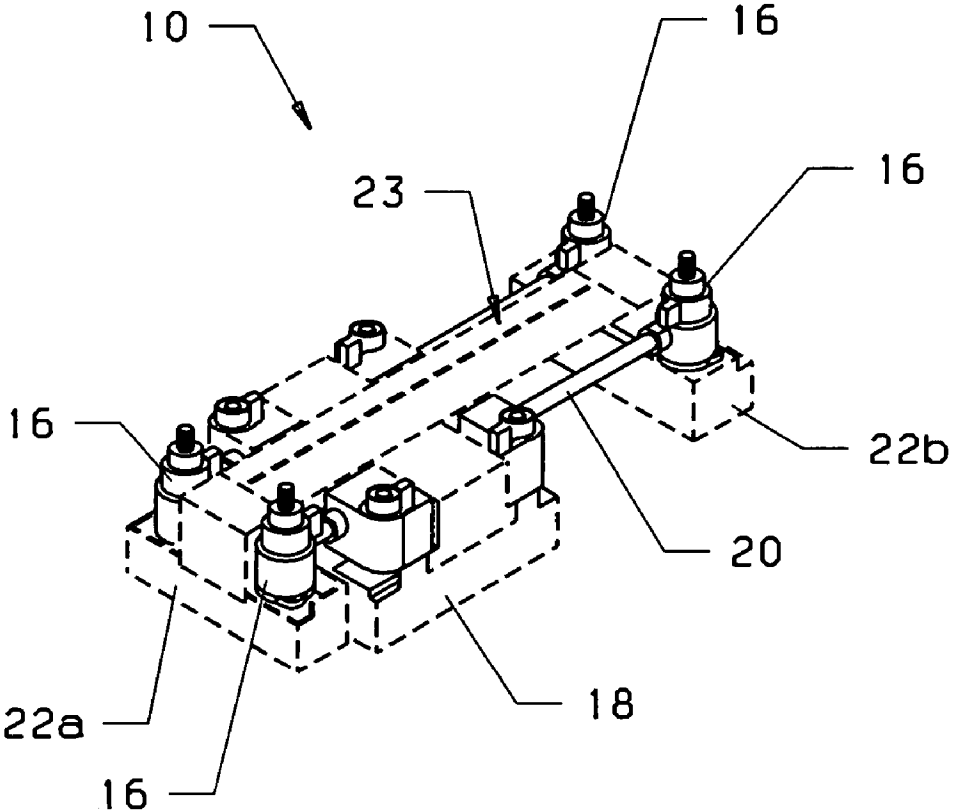
FIG. 3 is a perspective view of the steam generator tube walker of the present invention.

Referring now to the drawings and particularly to FIGS. 3 and 4, an improved manipulator system (10) is shown having a tube walker assembly (11) mounted in a known manner on top of a known manipulator assembly (12) described in the prior art section and shown in FIGS. 1 and 2 having an arm (14) for holding equipment for the examination and/or repair of any steam generator tubes found to be defective. The manipulator (12) is inserted into the steam generator at a particular location within the tube bundle (9) in six successive steps as shown in FIG. 2. The arm (12) of the manipulator is now free to move to various tubes within the tube bundle (9). This allows for the tubing to be examined and cleaned or repaired if needed using well known instrumentation for accomplishing these functions.

Figure 5:
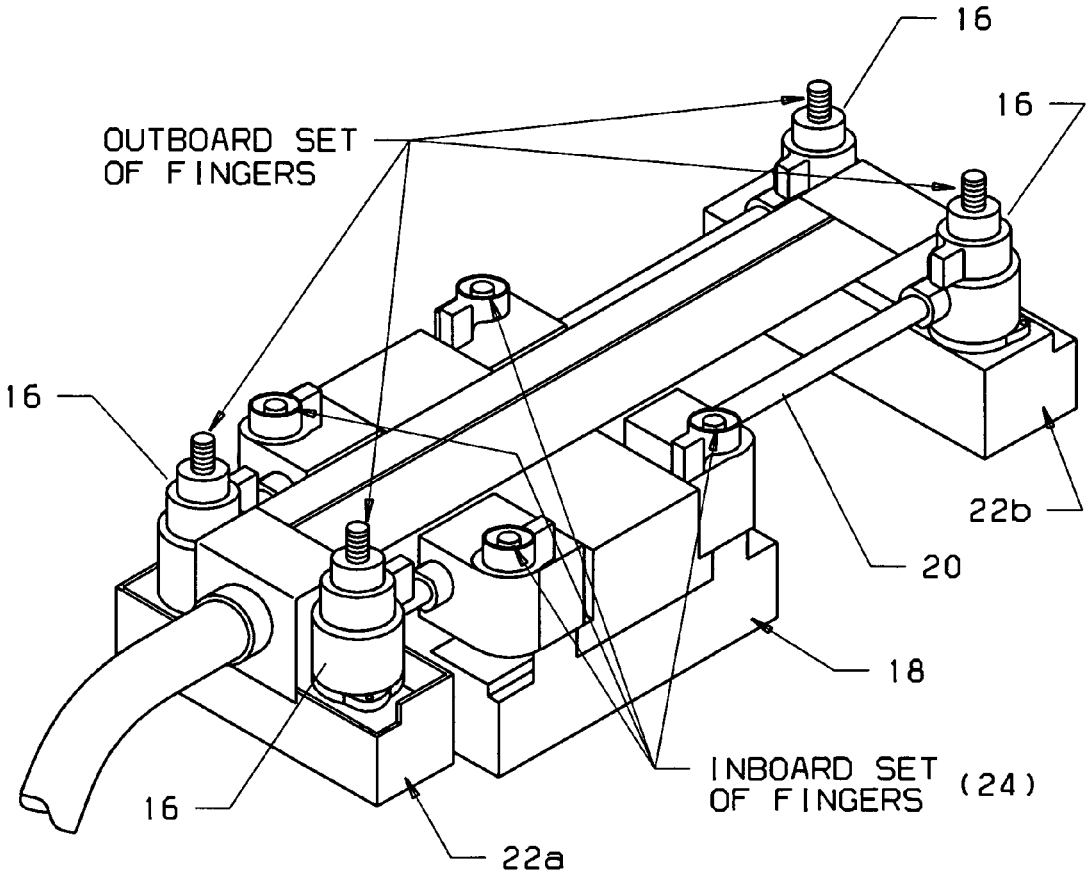
FIG. 5 is an enlarged perspective view of the tube walker of FIG. 3. The outboard fingers are extended for grasping a tube location and the inboard fingers are retracted to allow movement of the inner section.
Figure 6:
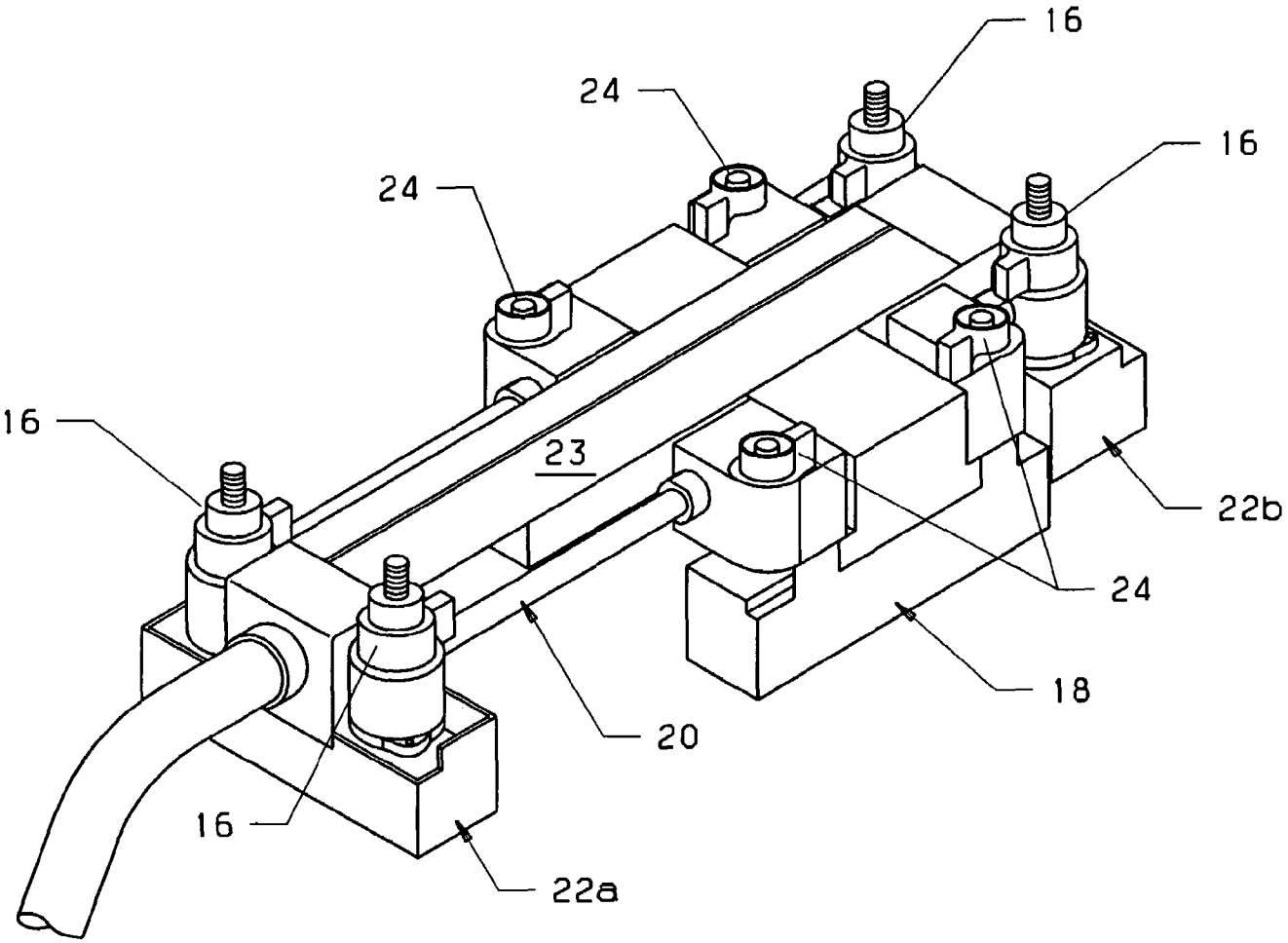
FIG. 6 is an enlarged perspective view of the FIG. 3 tube walker. This figure shows the inner section moved to a location for alignment with a new set of steam generator tubes to be grasped.

This improved manipulator system (10) is composed of two main parts including the manipulator (12) and the tube walker assembly (11). Part one is the tube walker assembly (11). This assembly (11) consists of a movable inner section (18) and a two part outboard section (22*a*; 22*b*) connected by a fixed plate (23) and rods (20). Each section (18; 22*a*; 22*b*) has a pair of hydraulically actuated locking fingers (16). These fingers (16) have a collet at the end which expands to grasp a tube which locates the system (10) at a particular tube location within the bundle (16). The outboard sections (22*a*; 22*b*), while locked in place as described, now allow the inner section (18) of the tube walker assembly (11) to be moved axially along rods (20) to the position shown in FIG. 6. The inner section (18) also contains a set of four fingers (24). Now with the inner portion in place, the fingers (24) are extended to engage with tubes of the tube bundle (9) as described earlier. This allows the inner section (18) to be locked in place with the aligned tubes of the bundle (9) and the four outboard fingers (16) can now be disengaged and retracted. The two parts of the outer section (22) can now be moved as an assembly to a new position with respect to the inner section (18) as seen in FIG. 5 but at an extended forward position with respect to the tube bundle (9). This combination of motion allows the walker (11) to traverse in a straight line from one side of the generator to the other and back. It will be understood that the spacing of the fingers (18, 22*a*, 22*b*) is preset to align with the tube spacing of the tube bundle (9).

Part two is the manipulator (12) used to inspect and repair the tubes. This component is very robust, and has successfully performed the required tasks.

This improved manipulator system (10) requires much less personnel support than the standard system. The standard system requires that personnel expend dose and time to manually relocate the manipulator. This works well but in some cases can potentially cause issues. The new system can be relocated in a consistent time frame and requires almost no personnel support. The walker can not change angular orientation, it can only move via straight line motion. It does this with the use of a motor and lead screw and some guide rods (not shown), similar to the known way the known manipulator (12) moves vertically up and down.

Figure 7:
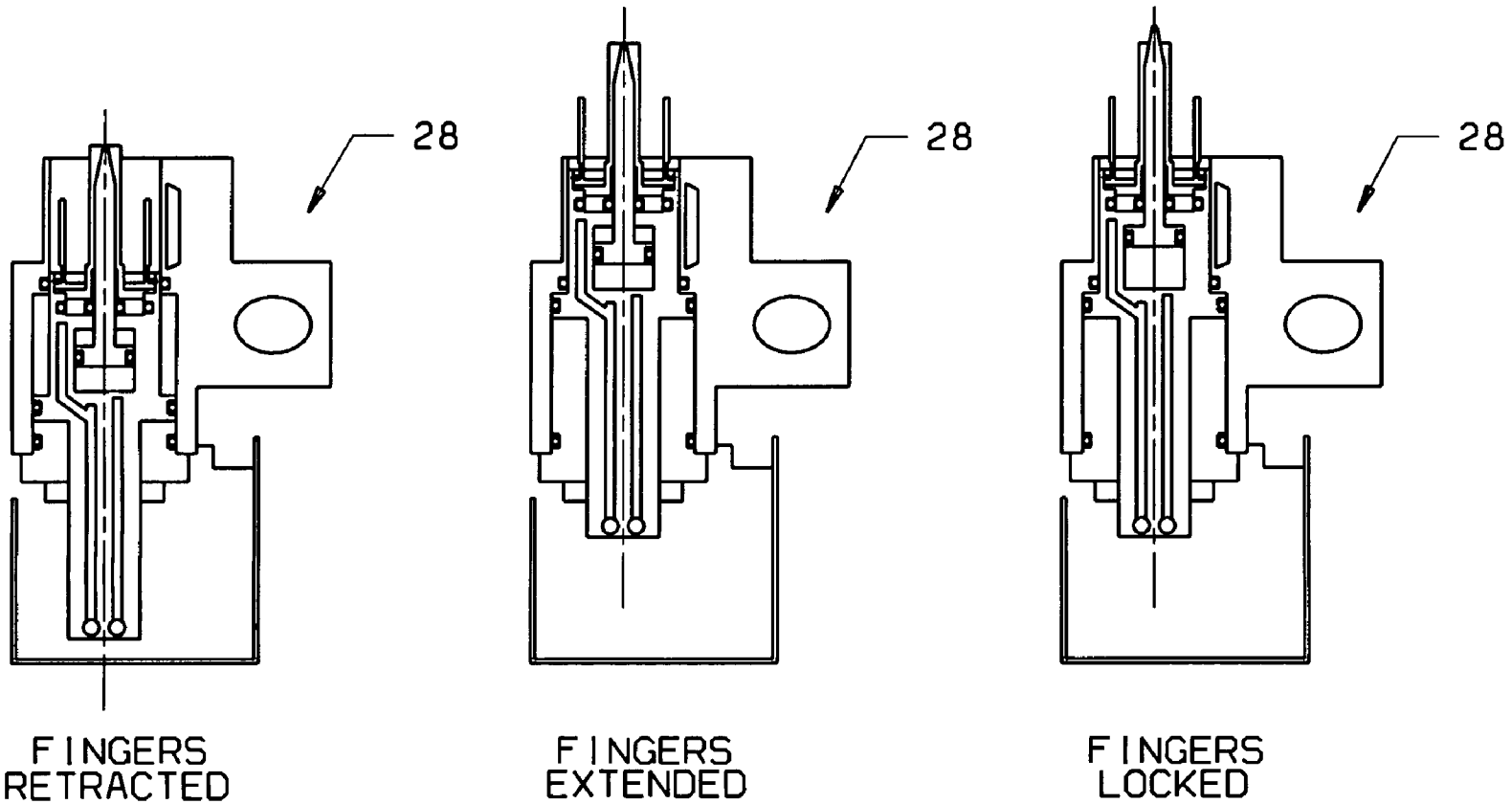
FIG. 7 depicts the hydraulic cylinders present at each finger of the tube walker. They are shown in the retracted, extended and locked positions.

Referring now to FIG. 7, it will be seen that each of the fingers (24; 16) has a nested hydraulic cylinder assembly (28) for moving them into the three positions indicated namely fingers retracted, fingers extended and fingers locked. In the retracted position the collet is retracted and free of the tubes of the tube bundle (9). In the extended position the collet is extended to the tubes of the bundle (9) and in the locked position the collet is grasping the tubes of the bundle (9).

It will be understood that certain details, obvious modifications and applications have been deleted herein for the sake of conciseness and readability but are fully intended to fall within the scope of the following claims.

We claim:

1. A system for remotely moving a manipulator assembly along a tube bundle in a steam generator comprising;

a manipulator assembly having means for inspecting and repairing reactor tubes of tube bundle;

a tube walker assembly affixed to the top of said manipulator assembly for remotely moving said manipulator assembly to a tube location along the tube bundle;

said tube walker assembly including a moveable inner portion mounted between a pair of fixed outer portions; and said inner portions and said outer portions having extendable and retractable fingers for selectively grasping tubes of the tube bundle to allow motion of said tube walker assembly there along.

2. The system as set forth in claim 1 including a pair of extendable fingers on each of said outer portions and extendable fingers on said inner portion with said inner portion fingers retracted whenever said outer portion fingers are extended.

3. The system as set forth in claim 2 wherein said outer portions have four fingers.

4. The system as set forth in claim 3 wherein each of said fingers of said inner portions and said outer portions has a retracted position, an extended position, and a locked position.

5. The system as set forth in claim 4 wherein each of said fingers has a collet at the end thereof for grasping the tube of the tube bundle.

6. A method of moving a manipulator along a tube bundle comprising the steps of:

mounting a reciprocating assembly having an inner portion with fingers for locking into tubes of the tube bundle mounted between a pair of outer portions having fingers for locking into tubes of the tube bundle;

locking the fingers of the outer portion to tubes of the tube bundle while retracting the fingers of the inner portion from the tube bundle;

moving the inner portion from a first position next to one of the pair of outer portions to a second position next to the other of the pair of outer portions;

locking the fingers of the inner portion to tubes of the tube bundle while retracting the fingers of outer portions from the tubes of the tube bundle; and moving the outer portions to a position where the other of the pair of outer portions is away from the inner portion and the one pair is next to the inner portion.

7. The method as set forth in claim 6 including the step of successively reciprocating the motion of the reciprocating assembly across the entire tube bundle.

8. The method as set forth in claim 6 including the step of mounting inspection and repair equipment to the manipulator for vertical movement inside the tube bundle.

9. The method as set forth in claim 8 including the step of spacing the distance between fingers of the inner portion to match the tube spacing of the tube bundle.

10. The method as set forth in claim 9 including the step of spacing the distance between fingers of the outer portions to match the tube spacing of the tube bundle.

* * * * *